US005701633A

United States Patent [19]

Jonischus

[11] Patent Number: 5,701,633

[45] Date of Patent: Dec. 30, 1997

[54] VACUUM CLEANING DEVICE WITH A SUCTION NOZZLE

[75] Inventor: Jürgen Jonischus, Romanshorn, Switzerland

[73] Assignee: Firma Fedag, Romanshorn, Switzerland

[21] Appl. No.: 671,400

[22] Filed: Jun. 26, 1996

[30] Foreign Application Priority Data

Jun. 28, 1995 [DE] Germany ..... 195 22 981.9

[51] Int. Cl.[6] ..... A47L 5/10; A47L 5/26

[52] U.S. Cl. ..... 15/387; 15/383

[58] Field of Search ..... 15/363, 377, 383, 15/387, 389

[56] References Cited

U.S. PATENT DOCUMENTS

| | | | |
|---|---|---|---|
| 2,078,634 | 4/1937 | Karlstrom . | |
| 3,849,823 | 11/1974 | Adamson et al. | 15/387 |
| 5,197,158 | 3/1993 | Moini | 15/387 |
| 5,345,650 | 9/1994 | Downham et al. | 15/387 |

FOREIGN PATENT DOCUMENTS

| | | |
|---|---|---|
| 3147164 | 6/1982 | Germany . |
| 3737548 | 5/1989 | Germany . |
| 3902917 | 8/1989 | Germany . |

*Primary Examiner*—David Scherbel
*Assistant Examiner*—Terrence Till
*Attorney, Agent, or Firm*—Robert W. Becker & Associates

[57] ABSTRACT

A vacuum cleaning device has a suction nozzle with a housing and an air guide chamber. The housing has an inflow opening. The suction nozzle further has a brush roller rotatably mounted adjacent to the inflow opening inside the housing. A bearing shaft is mounted within the housing. An air turbine is rotatably supported on the bearing shaft and driven in rotation by the suction air stream generated with the vacuum cleaning device. The bearing shaft has a longitudinal axis and the axis of rotation of the air turbine coincides with the longitudinal axis. The air turbine rotates at a different rpm than the bearing shaft. A planetary gear system is operatively connected between the air turbine and the bearing shaft. The planetary gear system is positioned at least partially within the air guide chamber within the vicinity of a first axial end face of the air turbine such that the air turbine at least partially axially overlaps the planetary gear system. A drive member is operatively connected to the planetary gear system for driving the brush roller.

10 Claims, 5 Drawing Sheets

VACUUM CLEANING DEVICE WITH A SUCTION NOZZLE

BACKGROUND OF THE INVENTION

The present invention relates to a vacuum cleaning device with a suction nozzle having a rotating brush roller in the area of an inflow opening and comprising an air turbine, driven by the suction air stream and arranged and rotatably supported within an air guide chamber of the suction nozzle housing, whereby the air turbine has coordinated therewith a gear system that is coupled at its drive side with a drive member for driving the brush roller.

Such a vacuum cleaning device is known from German document 39 02 917 having a suction nozzle with a rotating brush roller arranged in the area of the inflow opening. The brush roller removes dirt particles from the surface of the floor covering to be cleaned. The removed dirt particles are guided with the suction air stream generated by the vacuum cleaning device into the device and are deposited in a manner known per se onto a filter. The brush roller is driven via a drive member by the air turbine which is rotatably supported within the suction air stream and which rotates at a high velocity. The air turbine is engaged on a bearing shaft which is supported within the housing of the suction nozzle.

For an effective cleaning of the floor covering it is necessary to convert the high rpm of the air turbine to a reduced rpm of the brush roller. For transmitting the desired rpm ratio, it is suggested according to German document 39 02 917 to arrange between the driven component, i.e., the air turbine, and the brush roller an intermediate disk whereby transmission means between the air turbine and the intermediate disk and between the intermediate disk and the brush roller are provided. By adjusting the radii of the air turbine or the bearing shaft of the air turbine, the intermediate disk, and the brush roller, the desired transmission ratio is achieved.

This known device has the disadvantage that the desired transmission ratio can only be adjusted with the aid of the intermediate disk. The axis of the intermediate disk does not align with the axis of the air turbine, and therefore a separate bearing for the intermediate disk must be provided. The arrangement of a further bearing within the housing of the suction nozzle requires additional manufacturing, mounting, and material expenditures. The eccentric arrangement of the intermediate disk relative to the axis of rotation of the air turbine furthermore increases the required constructive space.

It is therefore an object of the present invention to provide a small transmission device that is easy to install for transmitting the rpm of the fast rotating air turbine onto the brush roller of a vacuum cleaning device so as to rotate at a reduced rpm.

SUMMARY OF THE INVENTION

The vacuum cleaning device according to the present invention is primarily characterized by:

A suction nozzle having a housing with an air guide chamber;

The housing comprising an inflow opening;

The suction nozzle having a brush roller rotatably mounted adjacent to the inflow opening inside the housing;

A bearing shaft mounted within the housing;

An air turbine rotatably supported on the bearing shaft and driven in rotation by a suction air stream generated with the vacuum cleaning device, wherein the bearing shaft has a longitudinal axis and wherein the axis of rotation of the air turbine coincides with the longitudinal axis;

The air turbine rotates at a different rpm than the bearing shaft;

A planetary gear system operatively connected between the air turbine and the bearing shaft;

The planetary gear system positioned at least partially within the air guide chamber within the vicinity of a first axial end face of the air turbine such that the air turbine at least partially axially overlaps the planetary gear system;

A drive member operatively connected to the planetary gear system for driving the brush roller.

Advantageously, the planetary gear system has an axial length and is positioned with the entire axial length in the air guide chamber.

Advantageously, the planetary gear system comprises three planetary gears, a toothed wheel fixedly connected to the air turbine, and a sun wheel fixedly connected to the housing, wherein the planetary gears have axles rotating with the bearing shaft and meshing with the sun wheel and the toothed wheel.

Preferably, the axles extend parallel to the longitudinal axis of the bearing shaft.

In a preferred embodiment of the present invention the sun wheel is a cup-shaped disk with a cylindrical inner wall having a toothing, wherein the toothing meshes with the planetary gears.

Expediently, the sun wheel has a first diameter and the toothed wheel has a second diameter, wherein the first diameter is twice as large as the second diameter.

Preferably, the vacuum cleaning device further comprises a drive gear, connected to a free end of the bearing shaft, wherein the drive member is a belt driven by the drive gear. Preferably, the belt is a toothed belt.

Advantageously, the air turbine has a second axial end face and the planetary gear system is positioned at the first axial end face and the drive member is positioned at the second axial end face on the bearing shaft.

Preferably, the planetary gear system and the drive member are connected axially adjacent to one another to the bearing shaft on a same side of the air turbine.

According to the present invention, the bearing shaft and the air turbine are rotatably supported whereby the rotational movement is coupled and adjustable with a transmission member in the form of a planetary gear system. The transmission member allows for a selection of the transmission ratio of the rpm of the air turbine and the bearing shaft whereby for a transmission ratio which is expediently greater than one, the fast rpm of the air turbine is transmitted into a slower rpm of the bearing shaft. The rpm reduction at the brush roller is accompanied by a torque increase acting on the brush roller. The rotational movement generated by the air turbine and transmitted onto the bearing shaft can be reduced to such an extent that the rpm of the bearing shaft corresponds substantially to the rpm of the brush roller.

Advantageously, the longitudinal axis of the bearing shaft coincides with the rotational axis of the air turbine so that the bearing shaft and air turbine have the same axes of rotation and are thus concentrically arranged relative to one another. However, they are able to perform independent rotational movements. This is achieved by supporting the bearing shaft within the housing of the suction nozzle and by arranging the air turbine so as to be rotatable about the bearing shaft.

The transmission member between the air turbine and the bearing shaft is expediently in the form of a planetary gear system that has the advantages of high force transmission and compact design.

The transmission member, respectively, the planetary gear system between the air turbine and the bearing shaft is advantageously positioned at a greater axial distance to one end face of the bearing shaft than the drive member between the bearing shaft and the brush roller. The planetary gear system can be displaced to such an extent in the direction of the center of the bearing shaft that it is at least partially enclosed by the air turbine in the axial direction. With such a space-saving arrangement the air turbine can be large so that the drive output is increased.

According to a further expedient embodiment the transmission member and the drive member are positioned at opposite axial end faces of the air turbine on the bearing shaft so that sections of the bearing shaft project axially relative to both end faces of the air turbine to thus provide a seat for the transmission member, respectively, the drive member.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 6.

Figure 1:
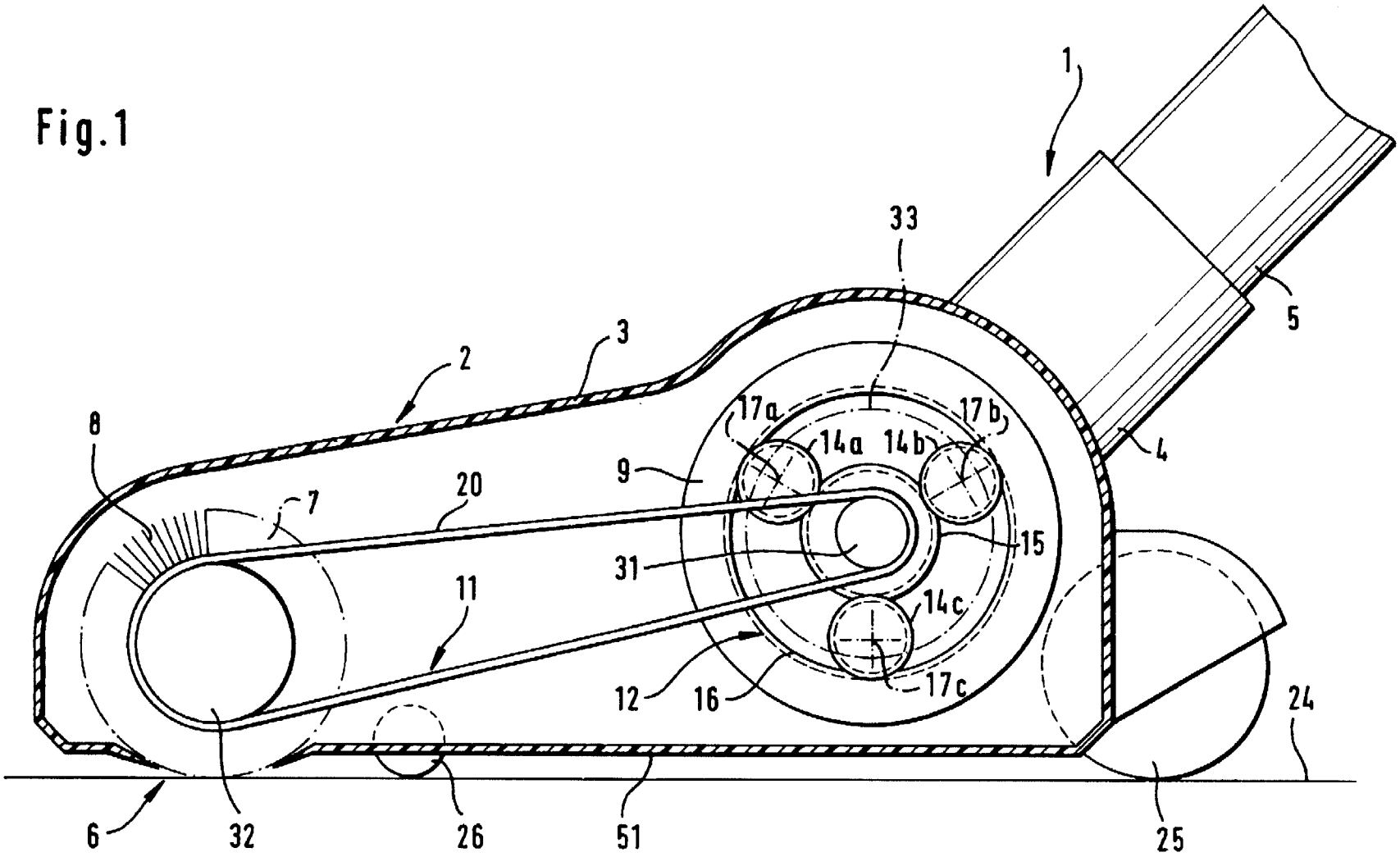
FIG. 1 shows a suction nozzle of a vacuum cleaning device in a side view.
Figure 2:
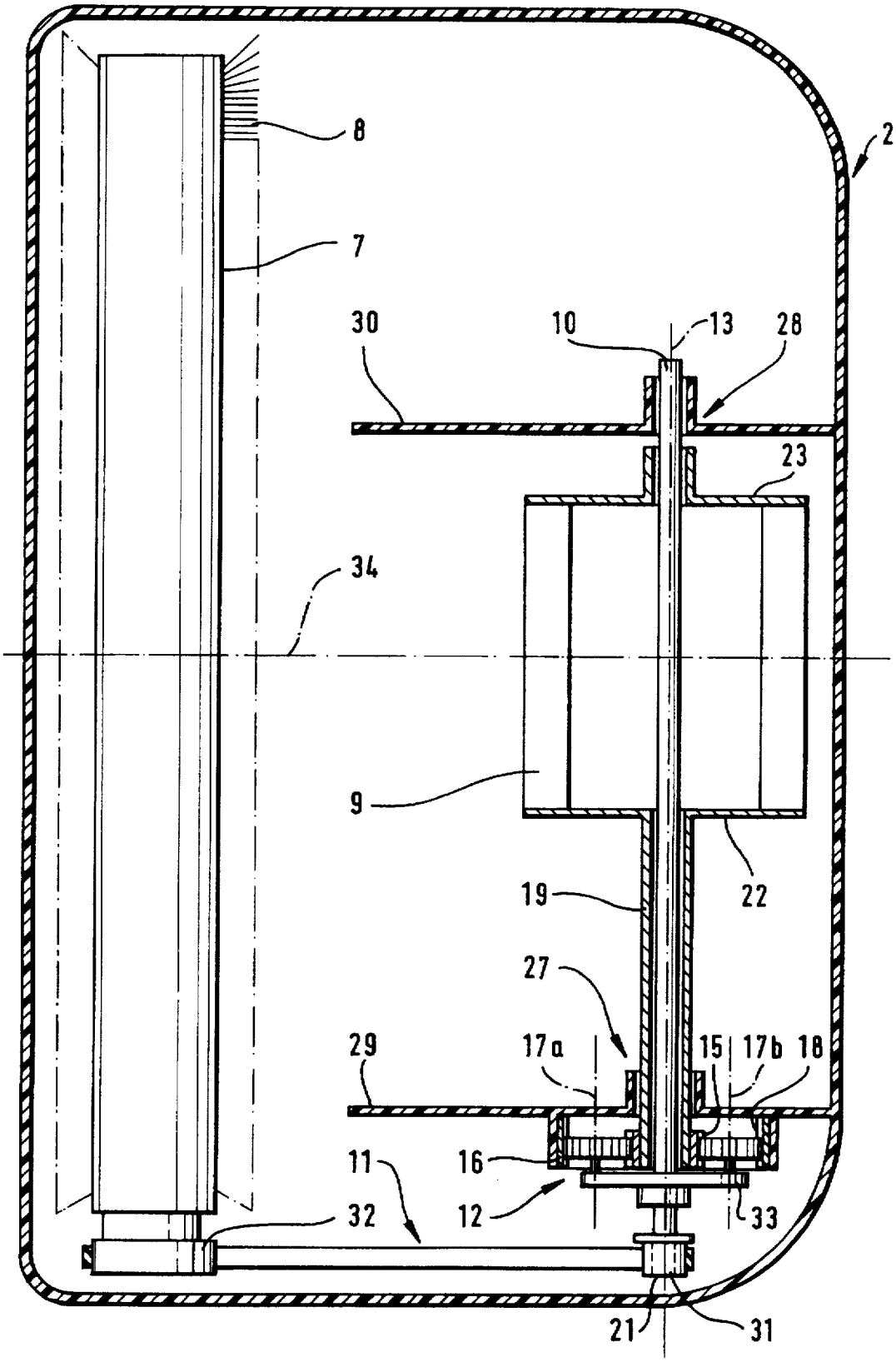
FIG. 2 shows the suction nozzle of FIG. 1 in a plan view.

The suction nozzle 2 represented in FIGS. 1 and 2 has at the forward end of its housing 3 a brush roller 7 which is provided with bristles 8 for cleaning the floor covering 24. The bristles 8 project past the inflow opening 6 and the underside 51 of the housing 3 facing the floor covering 24 and remove or loosen dirt particles from the floor covering. The dirt particles are entrained by the suction air stream and introduced through the inflow opening 6 into the housing. They are guided via the connector 4 of the suction nozzle 2 into the suction line 5 of the vacuum cleaning device 1 not represented in detail. For improving manipulation of the suction nozzle 2 casters 25, 26 are provided.

For an effective cleaning of the floor covering 24 the brush roller 7 is driven in rotation. For this purpose a force-transmitting drive member 11 is provided that in the shown embodiment is a belt. The belt is advantageously a toothed belt or a flat belt. The drive member 11 is wound about the brush roller 7 and driven by the air turbine 9 which is rotatably supported in the housing and driven by the suction air stream. The air turbine 9 is arranged on a bearing shaft 10 whereby the bearing shaft 10 is guided within bearings 27, 28 which are provided at stays 29, 30 fixedly connected to the housing. The longitudinal axis 13 of the bearing shaft 10 is identical to the axis of rotation of the air turbine 9. Bearing shaft and air turbine are coaxially arranged relative to one another.

The air turbine 9 rotates within the suction air stream at a high rpm which is higher than the desired rpm of the brush roller 7. In order to be able to reduce the high rpm of the air turbine 9 to the desired low rpm of the brush roller 7 providing higher torque, it is suggested that the air turbine 9 is rotatably supported on the bearing shaft 10 so that a rotation of the bearing shaft 10 within the bearings 27, 28 at the housing as well as a rotation of the air turbine 9 on the bearing shaft 10 is made possible. The rotational movement of the air turbine 9 and of the bearing shaft 10 are coupled to one another with a transmission member 12 by transmitting the rotation of the air turbine with the transmission member 12 into a rotation of the bearing shaft 10. The transmission is such that the transmission ratio of the rpm of the air turbine 9 and of the bearing shaft 10 is different from one, especially greater than one. The high rpm of the air turbine 9 is thus transmitted into a lower rpm of the bearing shaft 10. The rotation of the bearing shaft 10 is transmitted via the drive member 11 onto the brush roller 7 whereby the transmission ratio between the air turbine 9 and the bearing shaft 10 is selected such that the bearing shaft 10 rotates already at the desired rpm of the brush roller 7 so that the rpm of the bearing shaft 10 must not be reduced any further.

It may, however, be advantageous to provide a further reduction (transmission ratio greater than one) between the bearing shaft and the brush roller. In this case, the diameter of one of the drive gears 31 positioned on the bearing shaft 10 on which the drive member 11 rotates, is smaller than the diameter of a corresponding gear 32 at the brush roller 7.

As a transmission member 12 between the air turbine 9 and the bearing shaft 10 a planetary gear system is used which has the advantages of providing a compact design and allowing transmission of high forces. The planetary gear system comprises three planetary gears 14*a*, 14*b*, 14*c* having axles 17*a*, 17*b*, 17*c* that extend parallel to the longitudinal axis 13 of the bearing shaft 10. A fixedly connected bearing disk 33 is provided at the bearing shaft 10. The three planetary gears 14*a*, 14*b*, 14*c* are rotatably supported at an end face of the bearing disk 33 facing the air turbine 9. The planetary gears 14*a*, 14*b*, 14*c* are positioned at a uniform angular distance relative to one another. The axles 17*a*, 17*b*, 17*c* of the planetary gear system are positioned at a radial distance to the longitudinal axis 13 of the bearing shaft 10. With each rotation of the bearing shaft 10, respectively, the bearing disk 33 the angular position of the axes of the three planetary gears will change so that the axes rotate at the same angular speed as the bearing shaft 10, independent of the own rotation of the planetary gears. The radial position of the planetary gears on the bearing disk 33 is selected such that an outer circumferential circle surrounding the planetary gears, with the longitudinal axis 13 of the bearing shaft 10 providing the axis of the circle, has a greater diameter than the bearing disk 33. The planetary gears 14*a*, 14*b*, 14*c* mesh with their outer circumference with the sun wheel 16 connected fixedly to the housing. The sun wheel 16 is preferably in the form of a cup-shaped disk and the cylindrical inner wall 18 of the sun wheel 16 is provided with a toothing. The face of the sun wheel 16 facing away from the air turbine 9 is connected to the stay 29 fastened to the housing.

The three planetary gears 14*a*, 14*b*, 14*c* mesh with their radially inwardly positioned side with the toothed wheel 15 which is fixedly connected to the air turbine 9. The rotational movement of the air turbine 9 is transmitted via the toothed wheel 15 onto the planetary gears 14*a*, 14*b*, 14*c*. The planetary gears mesh with their outer circumference with the sun wheel 16 fixedly connected to the stay 29 and are thus forced into a circular trajectory having a circular axis coinciding with the longitudinal axis 13 of the bearing shaft 10. Since the planetary gears are fixedly connected via the bearing disk 33 to the bearing shaft 16, the rotational movement of the air turbine 9 is thus transmitted onto the bearing shaft 10. The rotational movement of the bearing shaft 10 is transmitted via the drive gear 31, arranged at the end face 21 of the bearing shaft 10, and via the drive member 11 onto the brush roller 7.

When a transmission ratio greater than one is desired, in which the angular velocity of the bearing shaft is smaller than that of the air turbine, the number of teeth of the housing-mounted sun wheel 16 must be selected to be within a certain ratio to the number of the teeth of the gear wheel 15 rotating with the air turbine. The ratio greater than one is always achieved when the sun wheel 16 has more than twice the number of teeth in comparison to the toothed wheel 15. Calculated with respect to the diameter this means that the sun wheel 16 must have a diameter which is at least twice as large as the diameter of the toothed wheel 15 in order to ensure that the bearing shaft 10 rotates at a smaller angular speed than the air turbine 9.

As can be seen in FIG. 2, a guide sleeve 19 is formed as a unitary part of the air turbine 9 which is rotatably supported on the bearing shaft 10. The guide sleeve 19 provides smooth running and stability for the air turbine during rotation on the bearing shaft. For reasons of symmetry it is advantageous to arrange the air turbine 9 symmetrically relative to the longitudinal center axis 34 of the suction nozzle 2. The guide sleeve 19 extends to the axial end face 22 of the air turbine 9 and penetrates the bearing 27 within the stay 29 at the housing. The toothed wheel 15 meshing with the planetary gears 14*a*, 14*b*, 14*c* is fixedly mounted on the end of the guide sleeve 19 remote from the air turbine 9.

At the free end of the bearing shaft 10, as shown in FIG. 2, the drive pinion 31 is fixedly mounted and drives the drive member 11 in the form of a V-belt. The drive pinion 31 is positioned in direct vicinity to the end face 21 of the bearing shaft 10. At a greater axial distance to the end face 21 the transmission member 12, i.e., the planetary gear system, is arranged for transmitting the air turbine movement onto the bearing shaft. The drive member 11 and the transmission member 12 in this embodiment are arranged at the same axial end face 22.

Figure 3:
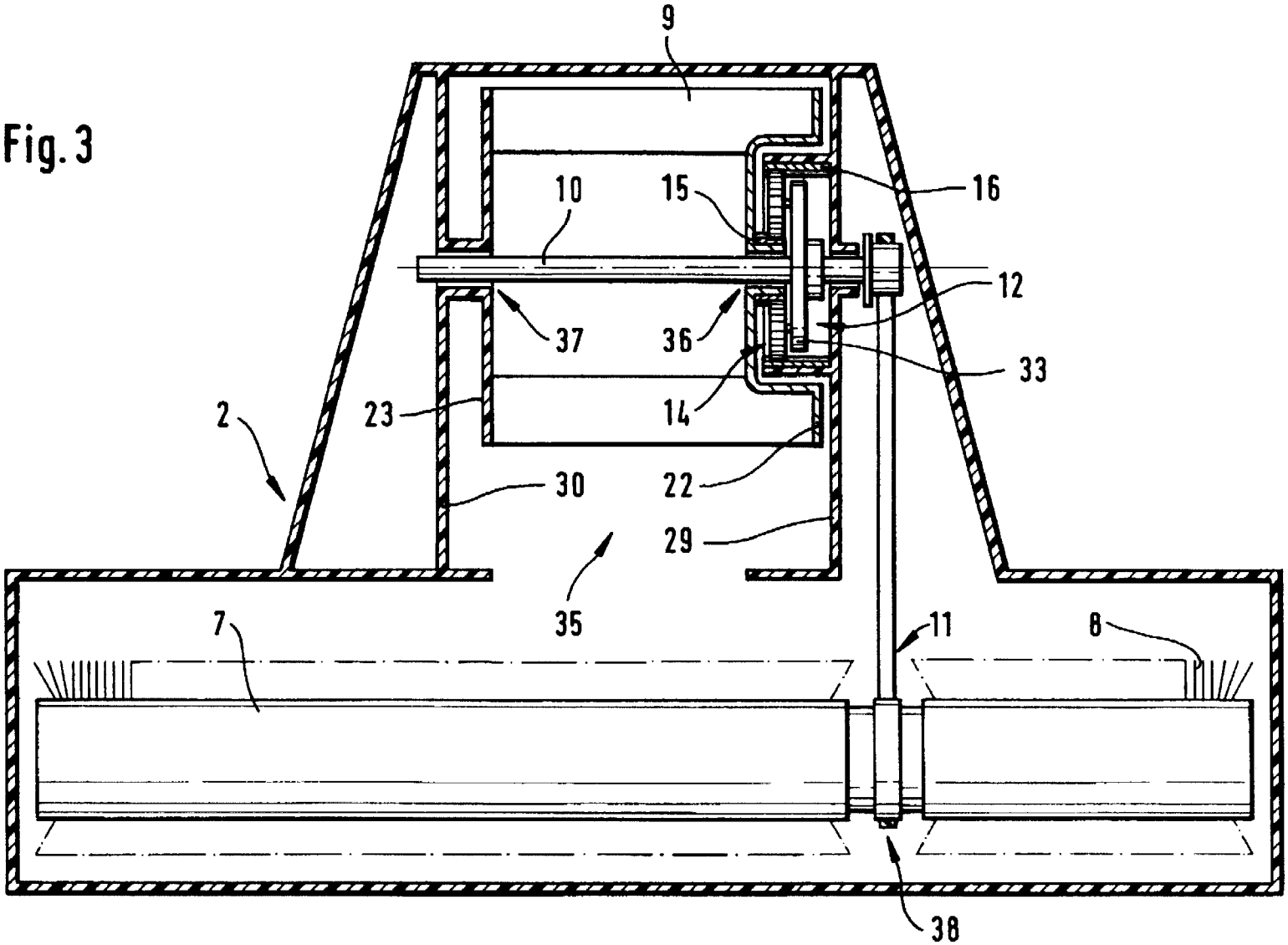
FIG. 3 shows a plan view of a suction nozzle in a further embodiment.

FIG. 3 shows a further embodiment of a suction nozzle 2. This embodiment is advantageous due to its especially compact design whereby the stays 29, 30 delimiting the air guide chamber 35 which receives the air turbine 9 are arranged directly adjacent to the axial end faces 22, 23 of the air turbine 9. The air turbine 9, without a guide sleeve, is provided at its end faces with axial bearing flanges 36, 37 via which the air turbine 9 is rotatably supported on the bearing shaft 10. The transmission member 12 and the drive member 11 are arranged at the same axial end face of the air turbine 9 whereby the transmission member 12 is positioned within the air guide chamber 35 delimited by the stays 29, 30. For this purpose, the sun wheel 16 is fastened to the inner side of the stay 29 facing the air turbine and receives in its cup-shaped interior the toothed wheel 15 of the air turbine 9 and the bearing disk 33 on the bearing shaft 10 including also the planetary gears 14 fastened to the bearing disk 33. In order to realize, despite the axial extension of the planetary gears within the air guide chamber 35, a maximum possible axial length of the air turbine 9, the air turbine projects at its end face 22 at least partially axially past the planetary gear system 12. It is advantageous that the radially outwardly positioned sections of the air turbine 9 completely surround the planetary gear system so that the planetary gear system is arranged within the interior space of the air turbine. This embodiment is represented in FIG. 3. The air turbine maintains its full output efficiency because the air turbine blades are arranged within the radially outwardly positioned area which remains unaffected by the planetary gear system.

The brush roller 7 has an axial extension which is substantially greater than that of the air turbine 9. The drive member 11 driven by the rotating bearing shaft 10 surrounds the brush roller in an area which is laterally displaced relative to the end face of the brush roller. In this area the arrangement of bristles 8 is interrupted. The section 38 divides the axial length of the brush roller 7 approximately in a ratio of 2:1.

Figure 4:
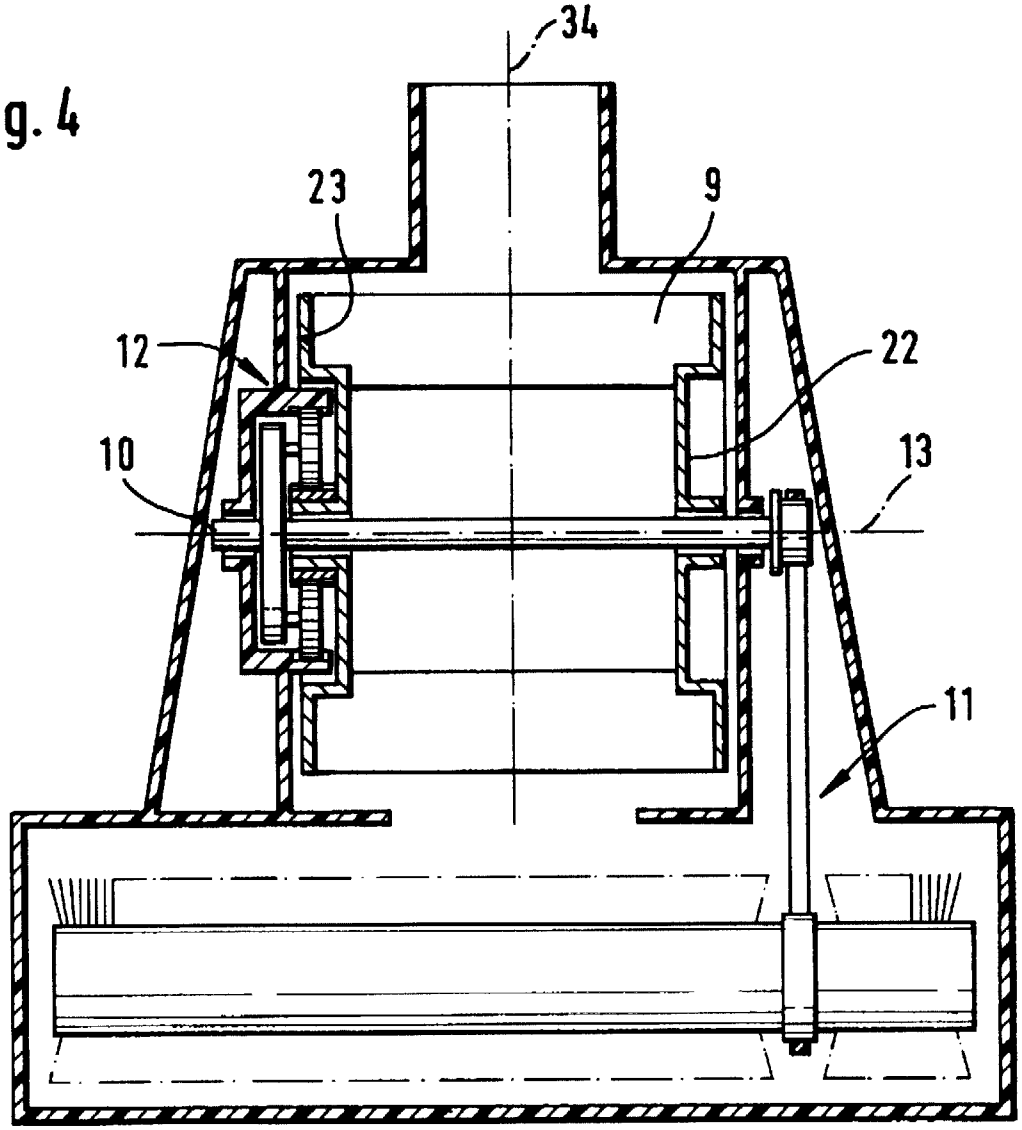
FIG. 4 shows a plan view of a suction nozzle in another embodiment.

In the embodiment represented in FIG. 4 the drive member 11 and the transmission member 12 are positioned on opposite axial end faces 22, 23 of the air turbine 9. The air turbine 9 is symmetrical relative to the center plane 34 which extends perpendicular to the longitudinal axis 13 of the bearing shaft 10. The air turbine 9 is provided at both axial end faces with a circular recess into which the planetary gear system can be partly or completely inserted. Due to this symmetrical design, the planetary gear system can be introduced into the air turbine from either side.

The transmission ratio of the planetary gear system is constant and greater than one. However, it may also be beneficial to have a variable transmission ratio whereby it is possible to adjust ratios of equal to one or smaller than one.

The drive of the brush roller can also be accomplished with an electric motor instead of the air turbine.

Figure 5:
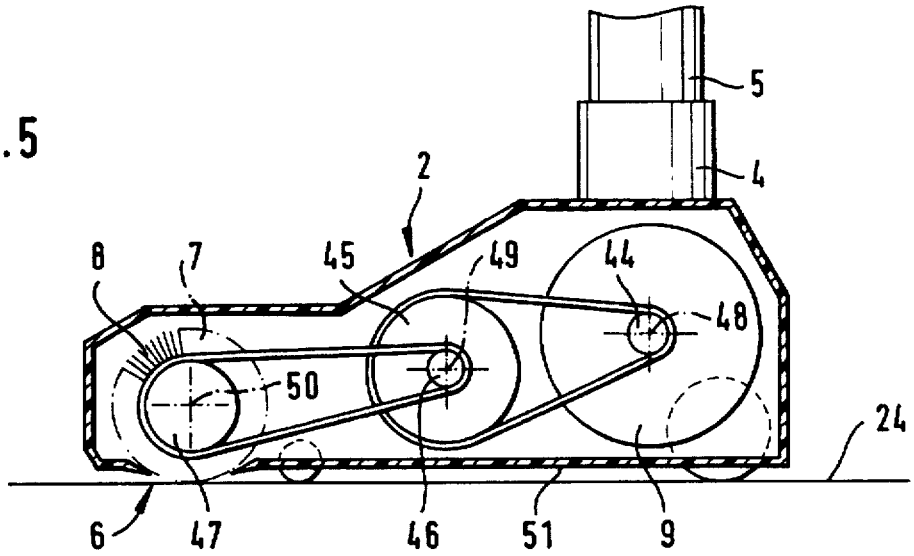
FIG. 5 shows a side view of a suction nozzle in yet another embodiment.
Figure 6:
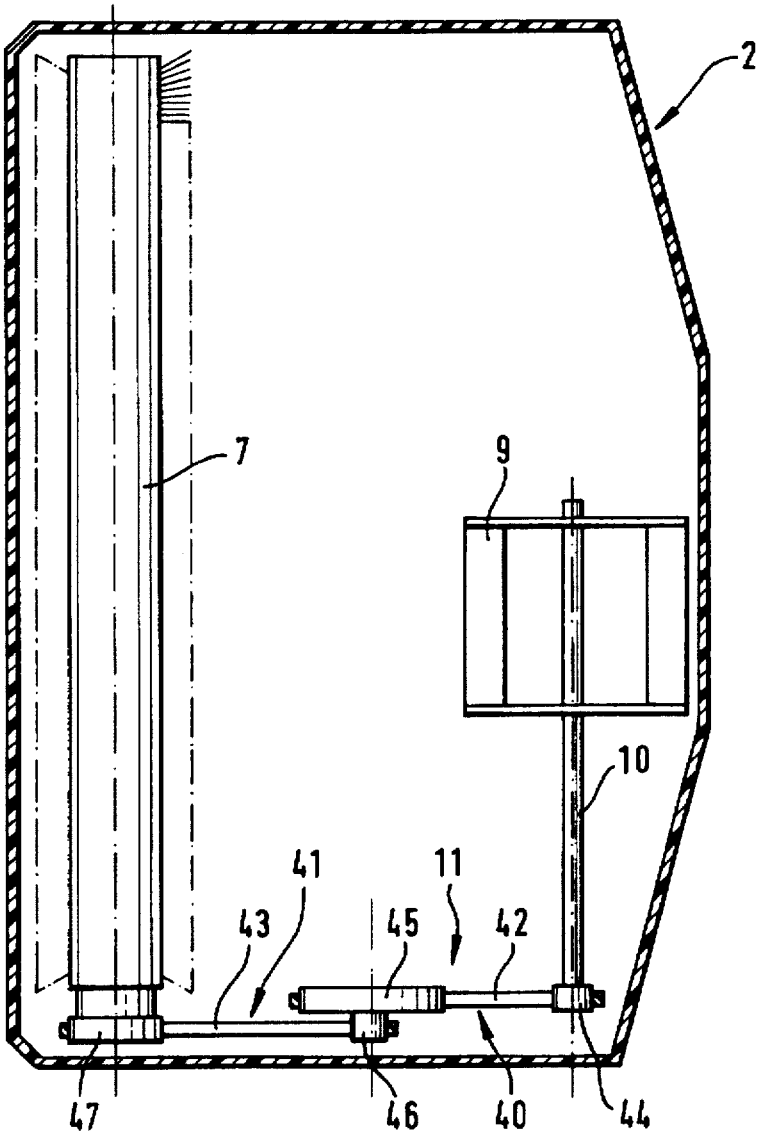
FIG. 6 shows a suction nozzle of FIG. 5 in a plan view.

FIGS. 5 and 6 show a further embodiment. At the forward part of the suction nozzle 2 in the area of the inflow opening 6 a rotatably driven brush roller 7 is arranged which with its bristles 8 picks up dirt particles from the floor covering 24. The dirt particles are conveyed into the area of the suction air stream and are guided via the connector 4 of the suction nozzle 2 into the suction line 5 of the vacuum cleaning device.

Within the suction nozzle 2 the air turbine 9 is arranged on the bearing shaft 10 in the area of the suction air stream whereby the rotational movement of the air turbine 9 and of the bearing shaft 10 caused by the suction air stream is transmitted via the drive member 11 onto the brush roller 7.

In order to reduce the high speed rotational movement of the air turbine with constructively simple and service-friendly means into a slow rotational movement of the brush roller, it is suggested that the drive member 11 be comprised of two belt drives 40, 41, connected in series, whereby each belt drive reduces a fast rotational movement to a slower rotational movement. Both belt drives 40, 41 are comprised of a V-belt 42, 43 whereby the first V-belt 42 is driven by a first drive pinion 44 that is fixedly connected to the bearing shaft 10 and thus rotates therewith and is arranged at the free end of the bearing shaft 10. At the drive side the V-belt 42 drives a pinion 45 that has a greater diameter than the first drive pinion 44. Fixedly connected to the drive pinion 45 is a second drive pinion 46 having a diameter that corresponds to that of the first drive pinion 44. The second drive pinion 46 drives the second V-belt 43 which surrounds the further pinion 47 at the drive side and is fixedly connected at the axial end face to the brush roller. It has a greater diameter than the second drive pinion 46 but a slightly smaller diameter than the drive pinion 45.

Each belt drive 40, 41 has between the driven and the driving side a transmission ratio greater than one so that in each case a fast rotating drive movement is reduced to a slower rotating driven movement. The total transmission ratio of the two belt drives connected in series corresponds, provided an identical tooth distance is provided at each pinion, to the product of each ratio of the diameter of the pinions at the driven side to that one of the drive side. If each pinion at the driven side is twice the size of that one of the drive side, then the total transmission ratio is 4, i.e., the angular velocity of the brush roller 7 is only one fourth of the one of the bearing shaft 10.

As can be seen in FIG. 5, the distance of the bearing axes 48, 49, 50 relative to the underside 51 of the suction nozzle 2 can be continuously reduced from the first drive pinion 44 to the second drive pinion 46 and to the pinion 47 of the brush roller 7. Thus, the air turbine 9 which has the same axis of rotation as the first drive pinion 44, may have a greater diameter and may be completely integrated within the housing of the suction nozzle.

The present invention is, of course, in no way restricted to the specific disclosure of the specification and drawings, but also encompasses any modifications within the scope of the appended claims.

What I claim is:

1. A vacuum cleaning device comprising:

a suction nozzle having a housing with an air guide chamber;

said housing comprising an inflow opening;

said suction nozzle having a brush roller rotatably mounted adjacent to said inflow opening inside said housing;

a bearing shaft mounted within said .housing;

an air turbine rotatably supported on said bearing shaft and driven in rotation by a suction air stream generated with said vacuum cleaning device, wherein said bearing shaft has a longitudinal axis and wherein an axis of rotation of said air turbine coincides with said longitudinal axis;

said air turbine rotates at a different rpm than said bearing shaft;

a planetary gear system operatively connected between said air turbine and said bearing shaft;

said planetary gear system positioned at least partially within said air guide chamber within a vicinity of a first axial end face of said air turbine such that said air turbine at least partially axially overlaps said planetary gear system;

a drive member operatively connected to said planetary gear system for driving said brush roller.

2. A vacuum cleaning device according to claim 1, wherein said planetary gear system has an axial length and is positioned with said entire axial length in said air guide chamber.

3. A vacuum cleaning system according to claim 1, wherein said planetary gear system comprises three planetary gears, a toothed wheel fixedly connected to said air turbine, and a sun wheel fixedly connected to said housing, wherein said planetary gears have axles rotating with said bearing shaft and meshing with said sun wheel and said toothed wheel.

4. A vacuum cleaning system according to claim 3, wherein said axles extend parallel to said longitudinal axis of said bearing shaft.

5. A vacuum cleaning device according to claim 3, wherein said sun wheel is a cup-shaped disk with a cylindrical inner wall having a toothing, wherein said toothing meshes with said planetary gears.

6. A vacuum cleaning device according to claim 3, wherein said sun wheel has a first diameter and said toothed wheel has a second diameter, wherein said first diameter is twice as large as said second diameter.

7. A vacuum cleaning device according to claim 1, further comprising a drive gear connected to a free end of said bearing shaft, wherein said drive member is a belt driven by said drive gear.

8. A vacuum cleaning device according to claim 7, wherein said belt is a toothed belt.

9. A vacuum cleaning device according to claim 1, wherein said air turbine has a second axial end face, and wherein said planetary gear system is positioned at said first axial end face and wherein said drive member is positioned at said second axial end face on said bearing shaft.

10. A vacuum cleaning device according to claim 1, wherein said planetary gear system and said drive member are connected axially adjacent to one another to said bearing shaft on a same side of said air turbine.

* * * * *